US011127362B2

(12) United States Patent
Shan

(10) Patent No.: US 11,127,362 B2
(45) Date of Patent: Sep. 21, 2021

(54) DRIVING METHOD AND DEVICE OF DISPLAY PANEL, AND DISPLAY APPARATUS

(71) Applicant: HKC CORPORATION LIMITED, Guangdong (CN)

(72) Inventor: Jianfeng Shan, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/035,706

(22) Filed: Sep. 29, 2020

(65) Prior Publication Data

US 2021/0012734 A1 Jan. 14, 2021

Related U.S. Application Data

(63) Continuation of application No. PCT/CN2019/076173, filed on Feb. 26, 2019.

(30) Foreign Application Priority Data

Jan. 30, 2019 (CN) ..... 201910094557.9

(51) Int. Cl.
*G09G 3/36* (2006.01)

(52) U.S. Cl.
CPC ..... *G09G 3/3614* (2013.01); *G09G 3/3685* (2013.01); *G09G 3/3607* (2013.01); *G09G 3/3674* (2013.01); *G09G 2300/0452* (2013.01); *G09G 2320/0242* (2013.01)

(58) Field of Classification Search
None
See application file for complete search history.

(56) References Cited

U.S. PATENT DOCUMENTS

2009/0109357 A1 4/2009 Liu et al.

FOREIGN PATENT DOCUMENTS

| | | | |
|---|---|---|---|
| CN | 102629059 | A | 8/2012 |
| CN | 105096899 | A | 11/2015 |
| CN | 105182649 | A | 12/2015 |
| CN | 106681040 | A | 5/2017 |
| CN | 107995958 | A | 5/2018 |
| CN | 108107634 | A | 6/2018 |

(Continued)

OTHER PUBLICATIONS

First Office Action in counterpart Chinese Application No. 201910094557.9 dated Jan. 6, 2020.

(Continued)

*Primary Examiner* — Aneeta Yodichkas

(57) ABSTRACT

Disclosed is a driving method and a device of display panel, as well as a display apparatus. Compared with the conventional design, adjacent pixel units in a display array in the application display panel are arranged alternately with high and low voltage intensities, polarities of adjacent subpixels in the display array are different, and common electrodes of subpixels in a same row are provided with two different preset voltages. The driving device drives the subpixels in the display array to perform point inversion driving according to the two different preset voltages in a driving period, which can reduce the probability of the phenomenon of viewing angle color shift of the display panel, and when the display panel operates with this driving period, the problem of viewing angle color shift of the display panel can be improved.

20 Claims, 3 Drawing Sheets

(56) References Cited

FOREIGN PATENT DOCUMENTS

| | | | |
|---|---|---|---|
| CN | 108109595 | A | 6/2018 |
| CN | 108831405 | A | 11/2018 |
| CN | 109036319 | A | 12/2018 |
| WO | 2016171096 | A1 | 10/2016 |

OTHER PUBLICATIONS

The Second Office Action in counterpart Chinese Application No. 201910094557.9, dated Sep. 1, 2020.
International Search Report in corresponding PCT Application No. PCT/CN2019/076173, dated Nov. 1, 2019.
Written Opinion of the International Searching Authority in corresponding PCT Application No. PCT/CN2019/076173, dated Nov. 1, 2019.

DRIVING METHOD AND DEVICE OF DISPLAY PANEL, AND DISPLAY APPARATUS

CROSS-REFERENCE OF RELATED APPLICATIONS

The present application is a continuation application of International Patent Application with No. PCT/CN2019/076173, filed on Feb. 26, 2019, which claims the benefit of a Chinese Patent Application with No. 201910094557.9, titled "DRIVING METHOD AND DEVICE OF DISPLAY PANEL, AND DISPLAY APPARATUS, AND STORAGE MEDIUM", filed in the National Intellectual Property Administration, PRC on Jan. 30, 2019, the entirety of which is hereby incorporated by reference.

TECHNICAL FIELD

The present disclosure relates to the field of displays technology, and more particularly relates to a driving method and device of display panel, and a display apparatus.

BACKGROUND

Large size liquid crystal display panels are mostly configured in vertical alignment (VA) type or in coplanar switching (IPS) type. Compared with IPS liquid crystal technology, VA type liquid crystal technology has the advantages of high production efficiency and low manufacturing cost, and also has the obvious defects in optical properties, such as color shift when large viewing angle images are presented.

When displaying an image, the brightness of a pixel should ideally change linearly with the voltage change, so that the driving voltage of the pixel can accurately represent the gray scale of the pixel and be reflected by the brightness. As shown in FIG. 1*a*, when VA type liquid crystal technology is used and the display screen is viewed from a smaller angle of view (e.g., front view), the brightness of the pixel can meet the ideal situation, i.e., it changes linearly with voltage, as shown by the ideal curve in FIG. 1*a*. However, when viewing the display screen at a larger viewing angle (e.g., 160 degrees or more to the display screen), due to the limitation of VA type liquid crystal technology, the brightness of the pixel appears to saturate rapidly with the voltage and then changes slowly, as shown in the actual curve in FIG. 1*a*. As a result, the gray scale that the driving voltage should have presented at a large viewing angle has seriously deviated, i.e. has a color shift.

The exemplary way to improve color shift is to subdivide each sub-pixel into a main pixel and a subpixel, then the main pixel is driven with a relatively high driving voltage and the subpixel is driven with a relatively low driving voltage. One sub-pixel is displayed by the main pixel and the subpixel together. The relatively high driving voltage and the relatively low driving voltage can maintain a constant relationship between brightness and corresponding gray scale at the front viewing angle when driving the main pixel and the subpixel. Generally, in the first half of the gray scale, the main pixel is driven and displayed with a relatively high driving voltage and the subpixel does not display in the manner shown in FIG. 1*b*, and the brightness of the whole sub-pixel is half that of the main pixel. In the second half of the gray scale, the main pixel is driven and displayed with a relatively high driving voltage and the subpixel is driven and displayed with a relatively low driving voltage, and the brightness of the whole sub-pixel is half of the sum of the brightness of the main pixel and the brightness of the subpixel. After this synthesis, the luminance curve at a large viewing angle is the actual curve in FIG. 1*b*, which is closer to ideal curve, so that the color shift under a large viewing angle is improved.

However, the problem with the above method is that double the number of metal traces and driving devices are needed to drive the subpixels, so that the transparent opening area is sacrificed, the light transmittance of the panel is affected, and the cost is also higher.

SUMMARY

The present disclosure provides a driving method and a driving device of display panel, as well as a display apparatus, which can solve the problem of color deviation of the viewing angle of current display panels.

The present disclosure provides a driving device of a display panel, the display panel includes a display array, the display array includes pixel units arranged in an array, the pixel unit includes three columns of subpixels arranged in sequence in the row direction, the polarities of adjacent subpixels in the display array are different, and adjacent pixel units in the display array are arranged alternately with high and low voltage intensities; the driving device of display panel includes a processor and a memory, the memory stores executable instructions, the processor executes the executable instructions, and the executable instructions include:

a first driving module, being configured to take two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage;

a second driving module, being configured to periodically invert a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage.

In some embodiments, polarities of adjacent subpixels in the row direction in the display array are different, and polarities of adjacent subpixels in a column direction in the display array are different.

In some embodiments, the first preset voltage is configured to control a first column subpixels and a third column of subpixels in two adjacent rows of the pixel units in the column direction;

The second preset voltage is configured to control a second column of subpixels in the two adjacent rows of the pixel units in the column direction.

In some embodiments, the driving device includes:

a grid driving module, being configured at one side of the display array and transmit scanning signals to the pixel units in the row direction of the display array;

the first driving module is further configured to take two frame running pictures of the display panel as a driving period, performing point inversion driving on a common electrode of first column subpixels and third column subpixels in a scanned single pixel unit with a first preset voltage in a first frame; and performing point inversion driving on a common electrode of second column subpixels in the scanned single pixel unit with a second preset voltage; and the second driving module is further configured to periodically invert the polarity of the first preset voltage in a second frame, and performing point inversion driving on the common electrode of the first column subpixels and third column subpixels in the scanned single pixel unit with an inverted first preset voltage; and periodically inverting the polarity of the second preset voltage, performing point inversion driving on the common electrode of the second column subpixels in the scanned single pixel unit with an inverted second preset voltage.

In some embodiments, the driving device further includes a source driving module, being configured at one end of the display array, a source data line is correspondingly provided to connect with the source driving module, and the source data line is connected with two adjacent columns of subpixels.

In some embodiments, the source data line controls subpixels located in two adjacent columns of a single pixel unit with a same polarity and different voltage intensities in the column direction.

In addition, in order to achieve the above object, the display panel comprises a display array, the display array comprises pixel units arranged in an array, the pixel unit includes three columns of subpixels arranged in sequence in a row direction, and adjacent pixel units in the display array are arranged alternately with high and low voltage intensities; the driving method includes:

taking two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage; and periodically inverting a polarity of the first preset voltage in a second frame, and performing point inversion driving on the common electrode of the first column subpixels and third column subpixels in the single pixel unit with an inverted first preset voltage; and periodically inverting a polarity of the second preset voltage, performing point inversion driving on the common electrode of the second column subpixels in the single pixel unit with an inverted second preset voltage.

In some embodiments, polarities of adjacent subpixels in the row direction in the display array are different, and polarities of adjacent subpixels in a column direction in the display array are different.

In some embodiments, the first preset voltage is configured to control a first column subpixels and a third column of subpixels in two adjacent rows of the pixel units in the column direction.

In some embodiments, the second preset voltage is configured to control a second column of subpixels in the two adjacent rows of the pixel units in the column direction.

In some embodiments, the operation of performing point inversion driving on first column subpixels and third column subpixels in a single pixel unit with a first preset voltage in a first frame; and performing point inversion driving on second column subpixels in the single pixel unit with a second preset voltage includes:

when in the first frame and if the first preset voltage is a first polarity, performing point inversion driving on the first column subpixels in the single pixel unit and the third column subpixels with the first preset voltage; and if the second preset voltage is a second polarity, performing point inversion driving on the second column subpixels in the single pixel unit with the second preset voltage;

the operation of periodically inverting a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage includes:

converting the first preset voltage from a first polarity to a second polarity in the second frame, and performing point inversion driving on the first column subpixels and the third column subpixels with the first preset voltage; and converting the second preset voltage from the second polarity to the first polarity, and performing point inversion driving on the second column subpixels in the single pixel unit with the second preset voltage.

In some embodiments, the operation of taking two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage includes:

taking two frame running pictures of the display panel as the driving period, when receiving a scanning signal transmitted by a grid driving module in the first frame, performing point inversion driving on a common electrode of first column subpixels and third column subpixels in a scanned single pixel unit with the first preset voltage; and performing point inversion driving on a common electrode of second column subpixels in the scanned single pixel unit with the second preset voltage;

the operation of periodically inverting a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage includes:

periodically inverting the polarity of the first preset voltage in the second frame, when receiving the scanning signal transmitted by the grid driving module in the first frame, performing point inversion driving on the common electrode of the first column subpixels and the third column subpixels in the scanned single pixel unit with the inverted first preset voltage; and periodically inverting the polarity of the second preset voltage, performing point inversion driving on the common electrode of the second column subpixels in the scanned single pixel unit with the inverted second preset voltage.

In some embodiments, one end of the display panel is provided with a source driving module, and a source data line is correspondingly provided to connect with the source driving module, and the source data line is connected with two adjacent columns of subpixels.

In some embodiments, the source data line controls subpixels located in two adjacent columns of a single pixel unit with a same polarity and different voltage intensities in the column direction.

In addition, in order to achieve the above objective, the present disclosure also provides a display apparatus, the display apparatus includes a display panel and a driving device of the display panel;

the display panel includes a display array, the display array includes pixel units arranged in an array, the display array includes pixel units arranged in an array, the polarities of adjacent subpixels in the display array are different, and adjacent pixel units in the display array are arranged alternately with high and low voltage intensities;

the driving device of display panel includes a processor and a memory, the memory stores executable instructions, the processor executes the executable instructions, and the executable instructions include:

taking two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage; and periodically inverting a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage.

According to the present disclosure, adjacent pixel units in the display array in the display panel are arranged alternately with high and low voltage intensities, polarities of adjacent subpixels in the display array are different, common electrodes of subpixels in a same row are provided with two different preset voltages, and the driving device drives subpixels in the display array to perform dot inversion driving according to the two different preset voltages in one driving period, so that the probability of the phenomenon of viewing angle color shift of the display panel can be reduced, and the display panel can operate with the driving period, so that the viewing angle color shift problem of the display panel can be improved.

BRIEF DESCRIPTION OF THE ACCOMPANYING DRAWINGS

FIG. 1*a* is a relationship graph between the color shift curve and the ideal curve before improving;

FIG. 1*b* is a relationship graph between the color shift curve and the ideal curve after improving;

Various implementations, functional features, and advantages of this disclosure will now be described in further detail in connection with some illustrative embodiments and the accompanying drawings.

DETAILED DESCRIPTION OF ILLUSTRATIVE EMBODIMENTS

It is understood that the specific embodiments described herein are merely illustrative of the disclosure and are not intended to limit the disclosure.

The technical scheme in the embodiment of the present application will be described clearly and completely below with reference to the drawings in the embodiment of the present application. Obviously, the described embodiment is only a part of the embodiment of the present application, but not all of the embodiments. All other embodiments obtained by a person of ordinary skill in the art without making creative efforts fall within the scope of protection of the present application. As a result of manufacturing techniques and/or tolerances, variations in the illustrated shape may be expected. Therefore, the embodiments of the present application should not be interpreted as being limited to the specific shapes of the regions shown herein, but include, for example, deviations in shape due to manufacturing. Therefore, the regions shown in the figures are schematic in nature, and their shapes are not intended to show the exact shape of the regions, and are not intended to limit the scope of the embodiments.

In the description of the present application, it is to be understood that the terms "straight", "lateral", "upper", "lower", "left", "right", "inside", "outside", etc. Indicate the orientation or positional relationship based on the drawings shown, and is merely for the convenience of describing the present application and the simplified description, and does not indicate or imply that the device or component referred to have a specific orientation or is constructed and operated in a specific orientation. Therefore, it should not be construed as limiting the application.

Moreover, the terms "first" and "second" are used for descriptive purposes only and are not to be construed as indicating or implying a relative importance or implicitly indicating the number of technical features. In the description of this application, unless otherwise stated, "a plurality" or "a plurality" means two or more than two.

In addition, the term "including" and any variations thereof are intended to cover non-exclusive inclusion.

Figure 1A:
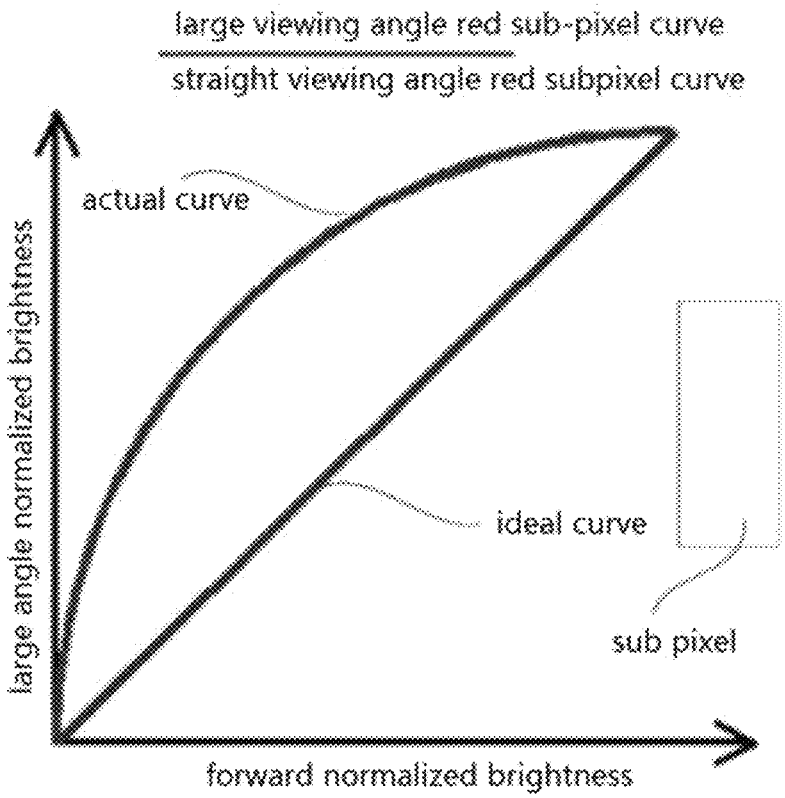
Figure 1B:
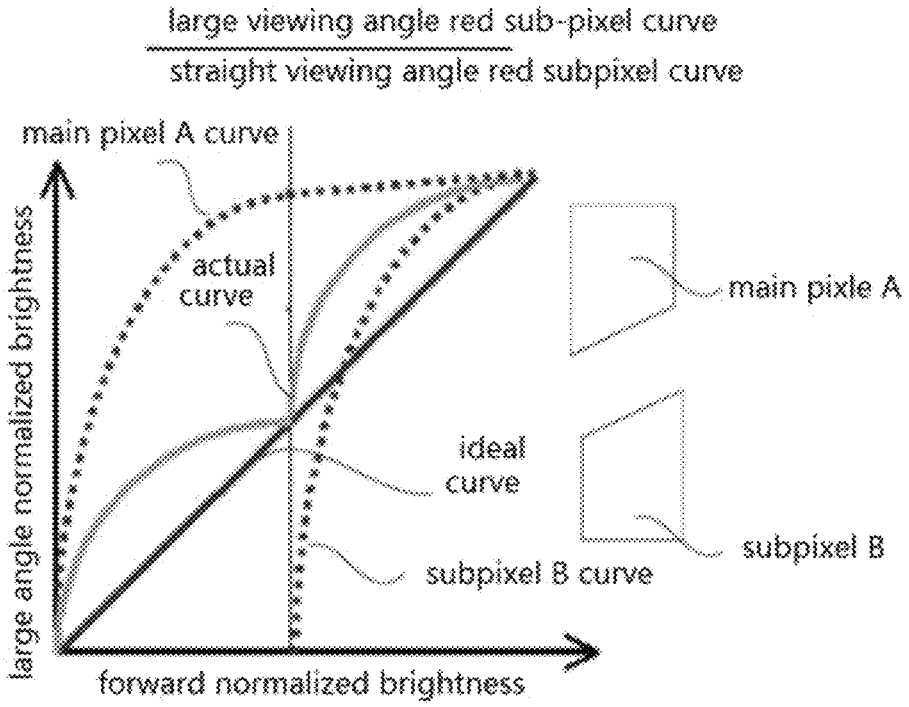
Figure 2:
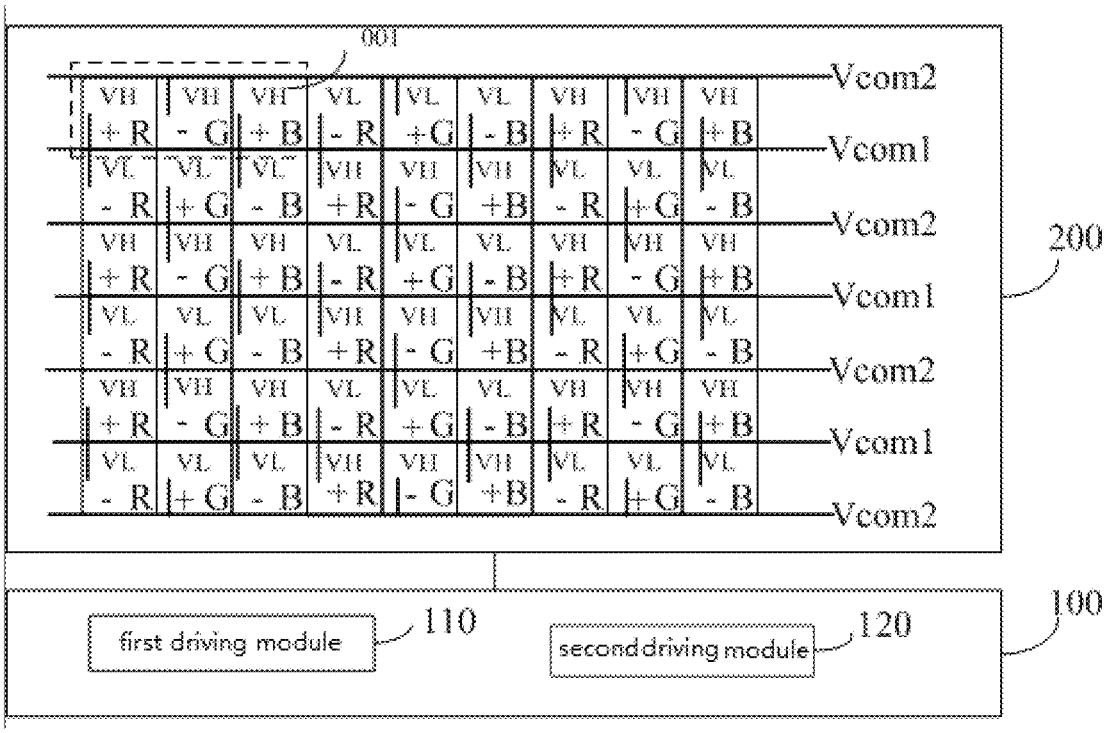
FIG. 2 is a schematic diagram of an embodiment of a driving device of display panel in accordance with this disclosure.

Referring to FIG. 2, FIG. 2 is a schematic diagram of an embodiment of a driving device of display panel in accordance with this disclosure.

As shown in FIG. 2, the display panel 200 in this embodiment includes a display array including pixel units 001 arranged in an array, the pixel units 001 including three columns of subpixels arranged in sequence in the row direction (the first column of subpixels is R subpixels, the second column of subpixels is G subpixels, and the third column of subpixels is B subpixels), and adjacent pixel units in the display array are arranged alternately in high and low voltage intensity. And the polarities of adjacent subpixels in the row direction in the display array are different, and the polarities of adjacent subpixels in the column direction in the display array are different.

It will be understood that, as shown in the display array of the display panel 200 in FIG. 2, one pixel unit 001 includes R subpixels (red), G subpixels (green), and B subpixels (blue) sequentially arranged in the row direction.

The voltage intensity of adjacent subpixels in the display array is different, i.e. the voltage intensity of subpixels can be divided into low voltage intensity (e.g. subpixels with L mark in FIG. 2) and high voltage intensity (e.g. subpixels with H mark in FIG. 2).

Figure 4:
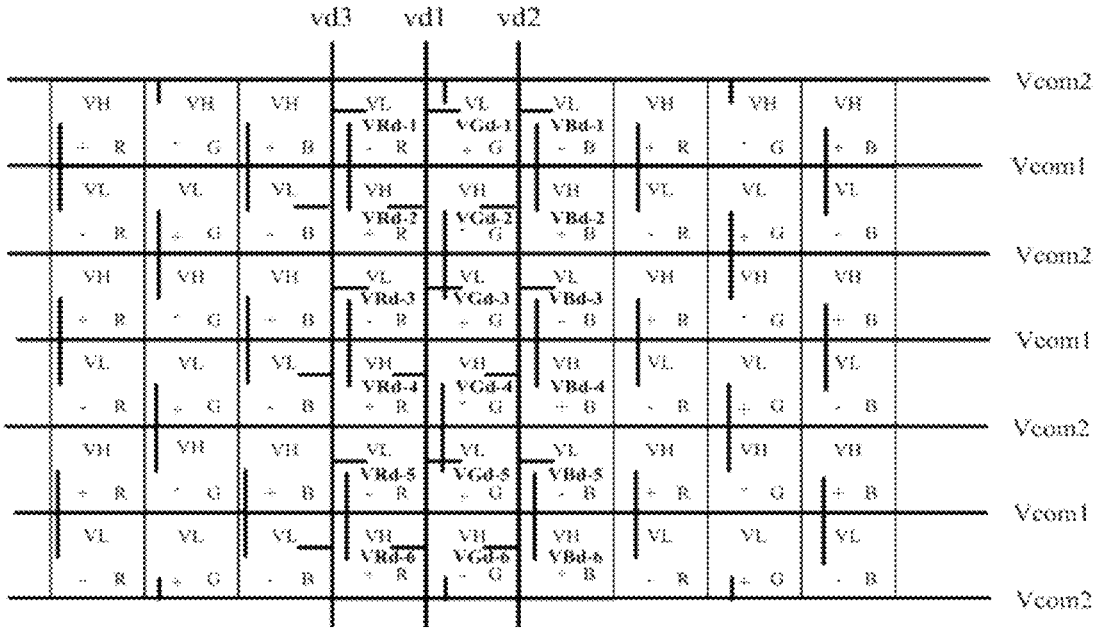
FIG. 4 is a schematic structural diagram of a display array of another embodiment in accordance with this disclosure.

Understandably, the display gray scale of the high voltage unit subpixel is brighter, while the display gray scale of the low voltage unit subpixel is darker. As shown in FIG. 4, adjacent R subpixels, g subpixels and b subpixels are arranged in a high and low voltage interleaved driving arrangement.

In this embodiment, the high voltage unit subpixels are positive, that is, the high voltage subpixels are driven with positive polarity in conjunction with the display panel. The low voltage unit sub-pixel is negative, that is, the low voltage sub-pixel is driven with negative polarity in conjunction with the display panel.

The driving device 100 includes a processor and a memory, the memory stores executable instructions, the processor executes the executable instructions, and the executable instructions include:

A first driving module 110, being configured to take two frame running pictures of the display panel as a driving period, performing point inversion driving on a common electrode of first column subpixels and third column subpixels with a first preset voltage in a first frame; and performing point inversion driving on a common electrode of second column subpixels in a single pixel unit with a second preset voltage.

It should be noted that the common driving voltage in this embodiment operates in a positive and negative polarity driving manner with respect to the original common electrode voltage of the display panel. For convenience of description, the original common electrode voltage of the display panel is recorded as Vcom, the first preset voltage is recorded as Vcom1, and the second preset voltage is recorded as Vcom2.

The driving device of the display panel of this embodiment also includes a grid driving module, which is arranged at one side of the display array and transmits scanning signals to each pixel unit in the row direction of the display array; a source driving module arranged at one end of the display array and transmitting a source driving signal to each pixel unit in the column direction of the display array.

It should be noted that a scanning signal in this embodiment scans a row of subpixels in the row direction.

Specifically, in this embodiment, when the scan signal transmitted by the gate drive module is received within the first frame with the two frames of operation of the display panel as a driving period, the common electrode of the first row of subpixels and the third row of subpixels in the scanned single pixel unit is driven by the first preset voltage Vcom1, at this time Vcom1 is relatively small with respect to the reference voltage Vcom, so the common electrode of the first row of subpixels and the third row of subpixels in the single pixel unit appears negative polarity, i.e., Vcom1 is characterized as a negative driving voltage. For example, if the pixel units in the first row and the second column are scanned, the common electrodes of the first column of subpixels VRd_1 and the third column of subpixels VBd_1 in the pixel units scanned are driven by the first preset voltage Vcom1.

At the same time, when receiving the scan signal transmitted by the gate drive module, the pixel units in the first row and the second column use the second preset voltage Vcom 2 to drive the common electrode of the second column of subpixels VGd_1. At this time, Vcom2 is relatively large relative to the reference voltage Vcom, so the common electrode of the second row of subpixels in a single pixel unit exhibits positive polarity, i.e., Vcom2 is characterized as a positive polarity driving voltage, and the common electrode of the second row of subpixels in a single pixel unit adopts the inverted Vcom2 for point inversion driving.

A second driving module 120, being configured to periodically invert the polarity of the first preset voltage in a second frame, and performing point inversion driving on a common electrode of first column subpixels and third column subpixels in a single pixel unit with an inverted first preset voltage; and periodically inverting the polarity of the second preset voltage, performing point inversion driving on a common electrode of second column subpixels in a single pixel unit with an inverted second preset voltage.

Figure 3:
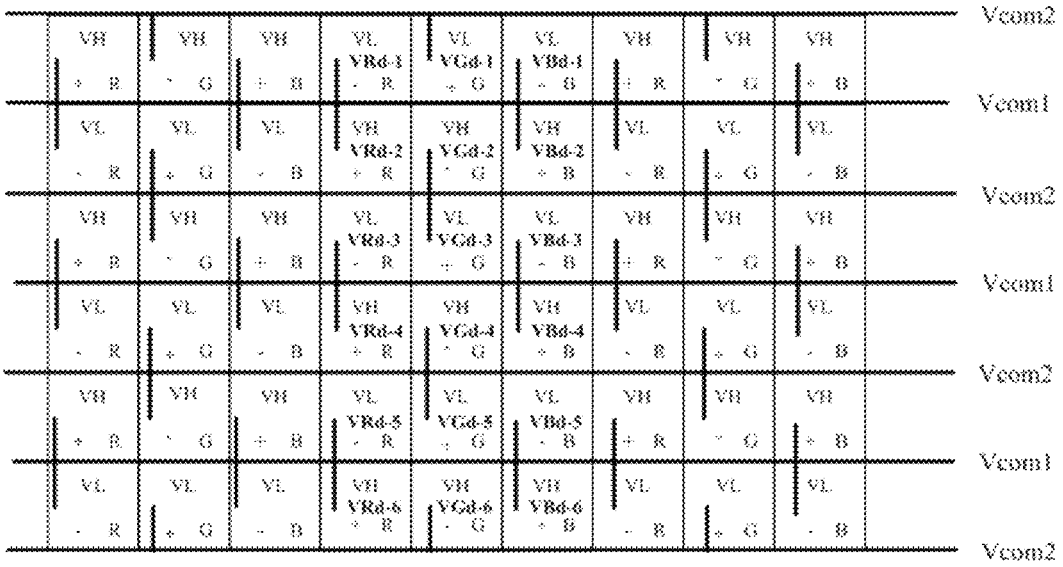
FIG. 3 is a schematic structural diagram of a display array of an embodiment in accordance with this disclosure.

Specifically, in this embodiment, the polarity of the first preset voltage Vcom1 is periodically reversed in the second frame, and the common electrodes of the first and third columns of subpixels in a single pixel unit are point reversed driven with the reversed Vcom1 voltage, at this time Vcom1 is larger relative to the reference voltage Vcom, so the common electrodes of the first and third columns of subpixels in a single pixel unit exhibit positive polarity, i.e., Vcom1 is characterized as a positive driving voltage. And periodically reverses the polarity of the second preset voltage Vcom2, when Vcom2 is relatively small relative to the reference voltage Vcom, the common electrode of the second row of subpixels in a single pixel unit exhibits negative polarity, i.e. Vcom2 represents negative polarity driving voltage, and the common electrode of the second row of subpixels in a single pixel unit adopts the reversed Vcom 2 for point inversion driving. After the display panel runs for one frame of image, for a certain column of pixel units, such as the second column of pixel units, referring to FIG. 3, the low voltage subpixels VGd_1, VGd_3, VGd_5 in FIG. 3 are driven from positive polarity to negative polarity, the high voltage subpixels VGd_2, VGd_4, VGd_6 are driven from negative polarity to positive polarity, and so on after the display panel runs for one frame of image.

According to the embodiment, adjacent pixel units in the display array in the display panel are arranged alternately with high and low voltage intensities, the polarities of adjacent subpixels in the display array are different, the common electrodes of subpixels in the same row are provided with two different preset voltages, and the driving device drives subpixels in the display array to perform dot inversion driving according to the two different preset voltages in one driving Period, so that the probability of the phenomenon of color shift of the viewing angle of the display panel can be reduced, and the display panel can operate with this driving Period, so that the problem of color shift of the viewing angle of the display panel can be improved.

Further, in the process of realizing the driving mode of subpixel point inversion as described above, if a conventional column of subpixels is controlled by only one column of source driving signals in the column direction, the polarity of the source driving signals in the same column will be frequently driven.

In this embodiment, the source driving module is correspondingly provided with source data lines connected with the source driving module, and the source data lines are connected with two adjacent sub-pixels; The source data line controls subpixels with the same polarity and different voltage intensities in two adjacent columns of subpixels in a single pixel unit in the column direction. The operation of the driving IC can be reduced, and the power consumption of the driving IC and the risk of temperature rise of the driving IC can be reduced. As shown in FIG. 3, taking the second column of pixel units as an example, the polarity of the subpixels VGd_1, VRd_2 and VGd_3 of the second column of pixel units is positive, the voltage intensity of the sub-pixel VGd_1 and the sub-pixel VRd_2 is different, and the voltage intensity of the sub-pixel VRd_2 and the sub-pixel are also different to VGd_3, which are driven by the same column of source drive signals Vd1.

The polarity of the subpixels of VBd_1, VGd_2 and VBd_3 is negative, the voltage intensity of the sub-pixel VBd_1 and subpixel VGd_2 is different, and the voltage intensity of the subpixel VGd_2 and subpixel is also different to VBd_3, which are driven by a common column of source driving signals Vd2.

Of course, the above structure may also be such that the subpixels of the sub-pixel VGd_1, the sub-pixel VRd_2 and the sub-pixel VGd_3 of the pixel unit of the second column have a negative polarity, they are driven by a column of source driving signals Vd1 in common, and the subpixels of VBd_1, VGd_2 and VBd_3 have a positive polarity, and they are driven by a column of source driving signals Vd2 in common. As long as it can be ensured that the same source drive signal controls subpixels with the same polarity and different voltage intensities in two adjacent columns of subpixels in a single pixel unit in the column direction.

This embodiment controls subpixels with the same polarity and different voltage intensities in two adjacent columns of subpixels in a single pixel unit in the column direction, can reduce the power consumption of the integrated circuit of the display and can control the temperature rise of the integrated circuit of the display.

Figure 5:
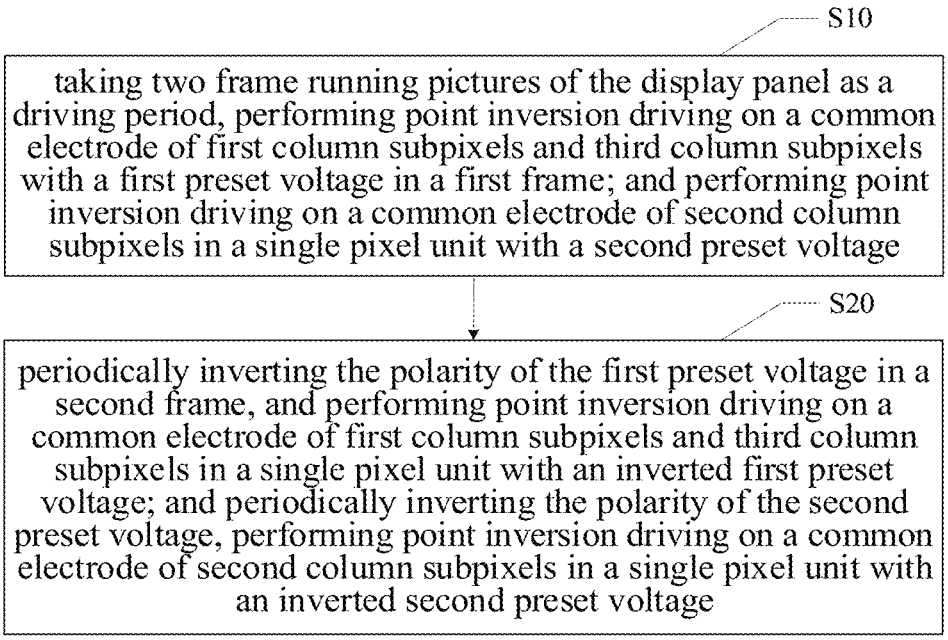
FIG. 5 is a flowchart of an embodiment of the driving method of display panel in accordance with this disclosure.

In addition, referring to FIG. 5, the application also provides a driving method of display panel, and FIG. 5 is a flowchart of an embodiment of the driving method of display panel in accordance with this disclosure.

In this embodiment, the display panel includes a display array, the display array includes pixel units arranged in an array, the pixel units include three columns of subpixels arranged in sequence in the row direction, and adjacent pixel units in the display array are arranged alternately with high and low voltage intensity. The driving method of display panel includes:

Step S10: taking two frame running pictures of the display panel as a driving period, performing point inversion driving on a common electrode of first column subpixels and third column subpixels with a first preset voltage in a first frame; and performing point inversion driving on a common electrode of second column subpixels in a single pixel unit with a second preset voltage.

It should be noted that the common driving voltage in this embodiment operates in a positive and negative polarity driving manner with respect to the original common electrode voltage of the display panel. For convenience of description, the original common electrode voltage of the display panel is recorded as Vcom, the first preset voltage is recorded as Vcom 1, and the second preset voltage is recorded as Vcom 2.

One side of the display array of the display panel of this embodiment is provided with a grid driving module that transmits scanning signals to each pixel unit in the row direction of the display array; One end of the display array is provided with a source driving module which transmits source driving signals to each pixel unit in the column direction of the display array.

In the specific implementation, two frames of running pictures of the display panel are taken as a driving period, and when the first preset voltage is of the first polarity in the first frame, the first row of subpixels and the third row of subpixels in a single pixel unit are driven by point inversion through the first preset voltage; when that second preset voltage is of the second polarity, point inversion drive is carried out on the second row of sub-pixel in the single pixel unit through the second preset voltage.

It should be noted that a scanning signal in this embodiment scans a row of subpixels in the row direction.

Specifically, when receiving the scan signal transmitted by the gate drive module within the first frame, the common electrode of the first row of subpixels and the third row of subpixels in the scanned single pixel unit is point-inverted with the first preset voltage Vcom1, at this time Vcom1 is smaller relative to the reference voltage Vcom, so the common electrode of the first row of subpixels and the third row of subpixels in the single pixel unit appears negative, i.e., Vcom1 is characterized as a negative drive voltage. For example, if the pixel units in the first row and the second column are scanned, the common electrodes of the first column of subpixels VRd_1 and the third column of subpixels VBd_1 in the pixel units scanned are driven by the first preset voltage Vcom1.

At the same time, when receiving the scan signal transmitted by the gate drive module, the pixel units of the first row and the second column use the second preset voltage Vcom2 to drive the common electrode of the second column of subpixels VGd_1. At this time, Vcom2 is relatively large relative to the reference voltage Vcom, so the common electrode of the second row of subpixels in a single pixel unit exhibits positive polarity, i.e. Vcom2 is characterized as a positive polarity driving voltage, and the common electrode of the second row of subpixels in a single pixel unit adopts the inverted Vcom 2 for point inversion driving.

Step S20: periodically inverting the polarity of the first preset voltage in a second frame, and performing point inversion driving on a common electrode of first column subpixels and third column subpixels in a single pixel unit with an inverted first preset voltage; and periodically inverting the polarity of the second preset voltage, performing point inversion driving on a common electrode of second column subpixels in a single pixel unit with an inverted second preset voltage.

In a specific implementation, the first preset voltage is converted from the first polarity to the second polarity in a second frame, and the step of performing dot inversion driving on the first column of subpixels and the third column of subpixels in the single pixel unit through the first preset voltage is performed. Then converting the second preset voltage from the second polarity to the first polarity, and executing the step of point inversion driving the second row of subpixels in the single pixel unit through the second preset voltage.

Specifically, in this embodiment, the polarity of the first preset voltage Vcom1 is periodically reversed in the second frame, and the common electrodes of the first and third columns of subpixels in a single pixel unit are point reversed driven with the reversed Vcom1 voltage, at this time Vcom1 is larger relative to the reference voltage Vcom, so the common electrodes of the first and third columns of subpixels in a single pixel unit exhibit positive polarity, i.e., Vcom1 is characterized as a positive driving voltage. And periodically reverses the polarity of the second preset voltage Vcom2, when Vcom2 is relatively small relative to the reference voltage Vcom, the common electrode of the second row of subpixels in a single pixel unit exhibits negative polarity, i.e. Vcom2 represents negative polarity driving voltage, and the common electrode of the second row of subpixels in a single pixel unit adopts the reversed Vcom2 for point inversion driving. After the display panel runs for one frame of image, for a certain column of pixel units, such as the second column of pixel units, referring to FIG. 3, the low voltage subpixels VGd_1, VGd_3, VGd_5 in FIG. 3 are driven from positive polarity to negative polarity, the high voltage subpixels VGd_2, VGd_4, VGd_6 are driven from negative polarity to positive polarity, and so on after the display panel runs for one frame of image.

According to the embodiment, adjacent pixel units in the display array in the display panel are arranged alternately with high and low voltage intensities, the polarities of adjacent subpixels in the display array are different, the common electrodes of subpixels in the same row are provided with two different preset voltages, and the driving device drives subpixels in the display array to perform dot inversion driving according to the two different preset voltages in one driving Period, so that the probability of the phenomenon of color shift of the viewing angle of the display panel can be reduced, and the display panel can operate with this driving Period, so that the problem of color shift of the viewing angle of the display panel can be improved.

In addition, the application also provides a display apparatus, referring to FIG. 5, which is a schematic structural diagram of the display device of the hardware operating environment according to the embodiment of the application. The display device includes a display panel and a display device as described above; The display panel includes a display array, the display array includes pixel units arranged in an array, the polarities of adjacent subpixels in the display array are different, and the driving device for alternately arranging the display panel with adjacent pixel units of high and low voltage intensity includes a processor and a memory, the memory stores executable instructions, the processor executes the executable instructions, and the executable instructions include:

A first driving module, being configured to take two frame running pictures of the display panel as a driving period, performing point inversion driving on a common electrode of first column subpixels and third column subpixels with a first preset voltage in a first frame; and performing point inversion driving on a common electrode of second column subpixels in a single pixel unit with a second preset voltage.

A second driving module, being configured to periodically invert the polarity of the first preset voltage in a second frame, and performing point inversion driving on a common electrode of first column subpixels and third column subpixels in a single pixel unit with an inverted first preset voltage; and periodically inverting the polarity of the second preset voltage, performing point inversion driving on a common electrode of second column subpixels in a single pixel unit with an inverted second preset voltage.

The display panel may be a liquid crystal display panel, and the display device may be a computer display screen, a television display screen, a tablet computer display screen, etc.

The above is only the preferred embodiment of the present application and is not therefore limiting the scope of the patent of the present application. The equivalent structure or equivalent process changes made in the application specification and drawings, or directly or indirectly applied in other related technical fields, are similarly included in the patent protection scope of this application.

What is claimed is:

1. A driving device of a display panel, wherein the display panel comprises a display array, the display array comprises pixel units arranged in an array, the pixel units comprises three columns of subpixels arranged in sequence in a row direction, polarities of adjacent subpixels in the display array are different, and adjacent pixel units in the display array are arranged alternately with high and low voltage intensities; the driving device of display panel comprises a processor and a memory, the memory storing executable instructions, and the processor executing the executable instructions, and the executable instructions comprise:

a first driving module, being configured to take two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage;

a second driving module, being configured to periodically invert a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage.

2. The driving device of claim 1, wherein polarities of adjacent subpixels in the row direction in the display array are different, and polarities of adjacent subpixels in a column direction in the display array are different.

3. The driving device of claim 2, wherein the first preset voltage is configured to control a first column subpixels and a third column of subpixels in two adjacent rows of the pixel units in the column direction;

the second preset voltage is configured to control a second column subpixels in the two adjacent rows of the pixel units in the column direction.

4. The driving device of claim 3, wherein the driving device comprises:

a grid driving module, being configured at one side of the display array and transmit scanning signals to the pixel units in the row direction of the display array;

the first driving module is further configured to take two frame running pictures of the display panel as a driving period, performing point inversion driving on a common electrode of first column subpixels and third column subpixels in a scanned single pixel unit with a first preset voltage in a first frame; and performing point inversion driving on a common electrode of second column subpixels in the scanned single pixel unit with a second preset voltage; and the second driving module is further configured to periodically invert the polarity of the first preset voltage in a second frame, and performing point inversion driving on the common electrode of the first column subpixels and third column subpixels in the scanned single pixel unit with an inverted first preset voltage; and periodically inverting the polarity of the second preset voltage, performing point inversion driving on the common electrode of the second column subpixels in the scanned single pixel unit with an inverted second preset voltage.

5. The driving device of claim 4, wherein the driving device further comprises a source driving module, being configured at one end of the display array, a source data line is correspondingly provided to connect with the source driving module, and the source data line is connected with two adjacent columns of subpixels.

6. The driving device of claim 5, wherein the source data line controls subpixels located in two adjacent columns of a single pixel unit with a same polarity and different voltage intensities in the column direction.

7. A driving method of display panel, wherein the display panel comprises a display array, the display array comprises pixel units arranged in an array, the pixel units comprises three columns of subpixels arranged in sequence in a row direction, and adjacent pixel units in the display array are arranged alternately with high and low voltage intensities; wherein the driving method comprises:

taking two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage; and periodically inverting a polarity of the first preset voltage in a second frame, and performing point inversion driving on the common electrode of the first column subpixels and third column subpixels in the single pixel unit with an inverted first preset voltage; and periodically inverting a polarity of the second preset voltage, performing point inversion driving on the common electrode of the second column subpixels in the single pixel unit with an inverted second preset voltage.

8. The driving method of claim 7, wherein polarities of adjacent subpixels in the row direction in the display array are different, and polarities of adjacent subpixels in a column direction in the display array are different.

9. The driving method of claim 8, wherein the first preset voltage is configured to control a first column subpixels and a third column of subpixels in two adjacent rows of the pixel units in the column direction.

10. The driving method of claim 7, wherein the second preset voltage is configured to control a second column of subpixels in two adjacent rows of the pixel units in the column direction.

11. The driving method of claim 10, wherein the operation of performing point inversion driving on first column subpixels and third column subpixels in a single pixel unit with a first preset voltage in a first frame; and performing point inversion driving on second column subpixels in the single pixel unit with a second preset voltage comprises:

when in the first frame and if the first preset voltage is a first polarity, performing point inversion driving on the first column subpixels and the third column subpixels with the first preset voltage; and if the second preset voltage is a second polarity, performing point inversion driving on the second column subpixels in the single pixel unit with the second preset voltage;

wherein the operation of periodically inverting the polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage comprises:

converting the first preset voltage from the first polarity to the second polarity in the second frame, and performing point inversion driving on the first column subpixels and the third column subpixels with the first preset voltage; and converting the second preset voltage from the second polarity to the first polarity, and performing point inversion driving on the second column subpixels in the single pixel unit with the second preset voltage.

12. The driving method of claim 10, wherein the operation of taking two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage comprises:

taking two frame running pictures of the display panel as the driving period, when receiving a scanning signal transmitted by a grid driving module in the first frame, performing point inversion driving on a common electrode of first column subpixels and third column subpixels in a scanned single pixel unit with the first preset voltage; and performing point inversion driving on a common electrode of second column subpixels in the scanned single pixel unit with the second preset voltage;

wherein the operation of periodically inverting a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage comprises:

periodically inverting the polarity of the first preset voltage in the second frame, when receiving the scanning signal transmitted by the grid driving module in the first frame, performing point inversion driving on the common electrode of the first column subpixels and the third column subpixels in the scanned single pixel unit with the inverted first preset voltage; and periodically inverting the polarity of the second preset voltage, performing point inversion driving on the common electrode of the second column subpixels in the scanned single pixel unit with the inverted second preset voltage.

13. The driving method of claim 12, wherein one end of the display panel is provided with a source driving module, and a source data line is correspondingly provided to connect with the source driving module, and the source data line is connected with two adjacent columns of subpixels.

14. The driving method of claim 13, wherein the source data line controls subpixels located in two adjacent columns of a single pixel unit with a same polarity and different voltage intensities in the column direction.

15. A display apparatus, wherein the display apparatus comprises a display panel and a driving device of display panel;

the display panel comprises a display array, the display array comprises pixel units arranged in an array, the display array comprises pixel units arranged in an array, polarities of adjacent subpixels in the display array are different, and adjacent pixel units in the display array are arranged alternately with high and low voltage intensities;

the driving device of display panel comprises a processor and a memory, wherein the memory stores executable instructions, the processor executes the executable instructions, and the executable instructions comprise:

taking two frame running pictures of the display panel as a driving period, performing point inversion driving on a common electrode of first column subpixels and third column subpixels in a single pixel unit with a first preset voltage in a first frame; and performing point inversion driving on a common electrode of second column subpixels in the single pixel unit with a second preset voltage; and periodically inverting a polarity of the first preset voltage in a second frame, and performing point inversion driving on the common electrode of the first column subpixels and the third column subpixels in the single pixel unit with an inverted first preset voltage; and periodically inverting a polarity of the second preset voltage, performing point inversion driving on the common electrode of the second column subpixels in the single pixel unit with an inverted second preset voltage.

16. The display apparatus of claim 15, wherein polarities of adjacent subpixels in a row direction in the display array are different, and polarities of adjacent subpixels in a column direction in the display array are different.

17. The display apparatus of claim 16, wherein the first preset voltage is configured to control a first column subpixels and a third column of subpixels in two adjacent rows of the pixel units in the column direction; and wherein the second preset voltage is configured to control a second column of subpixels in the two adjacent rows of the pixel units in the column direction.

18. The display apparatus of claim 17, wherein the driving device comprises:

a grid driving module, being configured at one side of the display array and transmit scanning signals to the pixel units in the row direction of the display array;

wherein the executable instructions comprise:

taking two frame running pictures of the display panel as a driving period, performing point inversion driving on a common electrode of first column subpixels and third column subpixels in a scanned single pixel unit with a first preset voltage in a first frame; and performing point inversion driving on a common electrode of second column subpixels in the scanned single pixel unit with a second preset voltage; and periodically inverting a polarity of the first preset voltage in a second frame, and performing point inversion driving on the common electrode of the first column subpixels and the third column subpixels in the scanned single pixel unit with an inverted first preset voltage; and periodically inverting a polarity of the second preset voltage, performing point inversion driving on the common electrode of the second column subpixels in the scanned single pixel unit with an inverted second preset voltage.

19. The display apparatus of claim 18, wherein the driving device further comprises a source driving module, being configured at one end of the display array, a source data line is correspondingly provided to connect with the source driving module, and the source data line is connected with two adjacent columns of subpixels.

20. The display apparatus of claim 19, wherein the source data line controls subpixels located in two adjacent columns of a single pixel unit with a same polarity and different voltage intensities in the column direction.

* * * * *